US010612206B2

(12) United States Patent
Genest

(10) Patent No.: US 10,612,206 B2
(45) **Date of Patent: *Apr. 7, 2020**

(54) FOUNDATION FOR THE SUPPORT OF A STRUCTURE AND METHOD OF INSTALLATION

(71) Applicant: Gaétan Genest, Lac-aux-Sables (CA)

(72) Inventor: Gaétan Genest, Lac-aux-Sables (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/432,361

(22) Filed: Jun. 5, 2019

(65) Prior Publication Data

US 2019/0284776 A1 Sep. 19, 2019

Related U.S. Application Data

(63) Continuation of application No. 15/254,982, filed on Sep. 1, 2016, now Pat. No. 10,344,443.

(60) Provisional application No. 62/333,601, filed on May 9, 2016.

(51) Int. Cl.

| | |
|---|---|
| ***E04H 12/20*** | (2006.01) |
| ***E02D 27/50*** | (2006.01) |
| ***E02D 27/42*** | (2006.01) |
| ***E04H 12/34*** | (2006.01) |

(52) U.S. Cl.

CPC ..... *E02D 27/50* (2013.01); *E02D 27/42* (2013.01); *E04H 12/20* (2013.01); *E04H 12/347* (2013.01)

(58) Field of Classification Search

None

See application file for complete search history.

(56) References Cited

U.S. PATENT DOCUMENTS

| | | | | | |
|---|---|---|---|---|---|
| 2,300,375 | A | * | 10/1942 | Turner | E04H 17/22 52/150 |
| 3,255,591 | A | * | 6/1966 | Thornley | E01D 19/14 405/225 |
| 3,809,346 | A | * | 5/1974 | Jackson | E04H 12/223 248/530 |
| 3,973,409 | A | * | 8/1976 | Asayama | E02D 5/74 405/259.5 |
| 4,052,827 | A | * | 10/1977 | Yancey | E02D 5/80 52/156 |
| 4,074,481 | A | * | 2/1978 | Lang | E02D 5/74 4/506 |
| 4,296,584 | A | * | 10/1981 | Lempa, Jr. | E04H 12/2292 52/169.13 |
| 4,813,815 | A | * | 3/1989 | McGehee | B63B 21/20 405/202 |

(Continued)

*Primary Examiner* — Basil S Katcheves

(74) *Attorney, Agent, or Firm* — Anglehart et al.

(57) ABSTRACT

A method for installing a foundation in a ground for supporting a structure thereon, the method comprising the drilling of a main column borehole in the ground along an axis parallel to an axis of a force exerted by a load of the structure, inserting a main column into the main column borehole, drilling at least one anchor borehole at an angle away from the main column, inserting an anchor into each of the at least one anchor borehole, injecting a sealant into each of the at least one anchor borehole, after the sealant is dry securing a base to a top of the main column, securing to the base and placing under tension each anchor inserted into each of the at least one anchor borehole, the tension being such as to counteract radial forces to be induced by the structure to a longitudinal axis of the main column.

19 Claims, 6 Drawing Sheets

(56) References Cited

U.S. PATENT DOCUMENTS 5,123,623 A * 6/1992 McNamara ..... E04H 12/2253 248/156
5,145,291 A * 9/1992 Bullivant ..... E02D 5/38 405/230
5,317,844 A * 6/1994 Legler ..... E04H 12/2276 52/152
5,636,482 A * 6/1997 Klager ..... E04H 12/2292 256/DIG. 5
5,775,038 A * 7/1998 Sauvageot ..... E01D 19/02 14/73.5
5,873,679 A * 2/1999 Cusimano ..... E02D 27/48 405/229
6,578,333 B1 * 6/2003 Gagliano ..... E02D 27/01 249/34
6,591,564 B2 * 7/2003 Cusimano ..... E02D 27/01 248/156
6,871,455 B1 * 3/2005 Cockman ..... E02D 5/801 135/118
6,887,016 B1 * 5/2005 Skeels ..... E02D 27/52 248/171
6,931,805 B2 * 8/2005 Gregory ..... E02D 37/00 52/146
7,207,149 B2 * 4/2007 Fyfe ..... E02D 27/42 156/73.2
7,240,743 B2 * 7/2007 Buss ..... G01N 1/08 175/20
7,571,577 B2 * 8/2009 Nanayakkara ..... E04H 9/10 14/73.5
7,805,895 B2 * 10/2010 Kristensen ..... E02D 27/42 52/169.6
8,162,569 B2 * 4/2012 Kennedy ..... E21D 21/00 299/11
8,714,881 B2 * 5/2014 Gagliano ..... E02D 5/22 405/231
8,950,980 B2 * 2/2015 Jones ..... E02D 27/44 405/230
9,016,005 B2 * 4/2015 Garcia Maestre ..... E02D 27/42 52/126.1
9,032,674 B2 * 5/2015 Schibsbye ..... E02D 27/42 52/223.4
9,145,682 B1 * 9/2015 Tanaka ..... E04C 3/32
10,344,443 B2 * 7/2019 Genest ..... E02D 27/42
2002/0148174 A1 * 10/2002 Sumner, Sr. ..... E02D 27/02 52/146
2008/0083190 A1 * 4/2008 Fearn ..... E04G 13/021 52/651.07
2010/0031589 A1 * 2/2010 Fernald ..... E02D 27/42 52/173.1

* cited by examiner

FOUNDATION FOR THE SUPPORT OF A STRUCTURE AND METHOD OF INSTALLATION

CROSS-REFERENCE TO RELATED APPLICATIONS

This application claims the benefits of U.S. provisional patent application No. 62/333,601 filed on May 9, 2016, which is herein incorporated by reference.

TECHNICAL FIELD

The present disclosure relates to a foundation for the support of a structure and method of installation. More specifically, the present disclosure relates to a foundation for supporting load support structures such as electrical transmission towers.

BACKGROUND

Installing foundations for securing load support structures, for example electrical transmission towers, in soft soil can be impractical and expensive as common techniques are very labor intensive.

Accordingly, there is a need for an anchoring base and method of installation that alleviates those disadvantages.

SUMMARY

It is a main advantage of the disclosed foundation and method of installation to provide for an efficient way to securely put in a foundation for the support of a structure in soft soils.

In order to do so, the foundation consists in a main column and one or more anchors held together by a base.

The foregoing and other objects, features, and advantages of this foundation will become more readily apparent from the following detailed description.

Accordingly, there is provided a method for installing a foundation in a ground for supporting a structure thereon, the method comprising:

a) drilling of a main column borehole in the ground along an axis parallel to an axis of a force exerted by a load of the structure;

b) inserting a main column into the main column borehole;

c) drilling at least one anchor borehole at an angle away from the main column;

d) inserting an anchor into each of the at least one anchor borehole;

e) injecting a sealant into each of the at least one anchor borehole;

f) letting the sealant dry;

g) securing a base to a top of the main column;

h) securing to the base and placing under tension each anchor inserted into each of the at least one anchor borehole, the tension being such as to counteract radial forces to be induced by the structure to a longitudinal axis of the main column.

There is also provided a method as described above, wherein the main column borehole is drilled into a bedrock under the ground to a depth such as to support the load or such that a soil composing the ground is sufficiently dense so as to support the load.

There is further provided a method as described above, wherein the main column is selected from a group consisting of a hollow tube, a solid cylinder and an H-beam. In the case where the main column is hollow, the method further comprises filling the main column with a dense and incompressible material, thereby increasing the compressive strength of the main column. The clearance between the main column and a wall of the main column borehole may also be filled with a sealant.

There is still further provided a method as described above, wherein the at least one anchor borehole is drilled into a bedrock under the ground to a depth so as to support the tension for counteracting the radial forces induced by the structure or such that a soil composing the ground is sufficiently dense so as to support the tension for counteracting the radial forces induced by the structure.

There is also provided a kit for installing a foundation in a ground for supporting a structure thereon, the kit comprising:

a main column;

a base configured to be secured to a top end of the main column and to support the structure;

at least one anchor; and a securing element associated with each of the at least one anchor; each securing element being configured to place under tension and secure the associated anchor to the base.

The main column in the kit may be in the form of a hollow tube, a solid cylinder or an H-beam. The kit may further comprise a tension application mechanism allowing for power to be simultaneously applied on each of the at least one anchor when secured to the base.

BRIEF DESCRIPTION OF THE FIGURES

Embodiments of the disclosure will be described by way of examples only with reference to the accompanying drawing, in which.

Similar references used in different Figures denote similar components.

DETAILED DESCRIPTION

Generally stated, the non-limitative illustrative embodiments of the present disclosure provide a foundation for the support of a structure and method of installation. The foundation is used to support load support structures such as electrical transmission towers.

Figure 1:
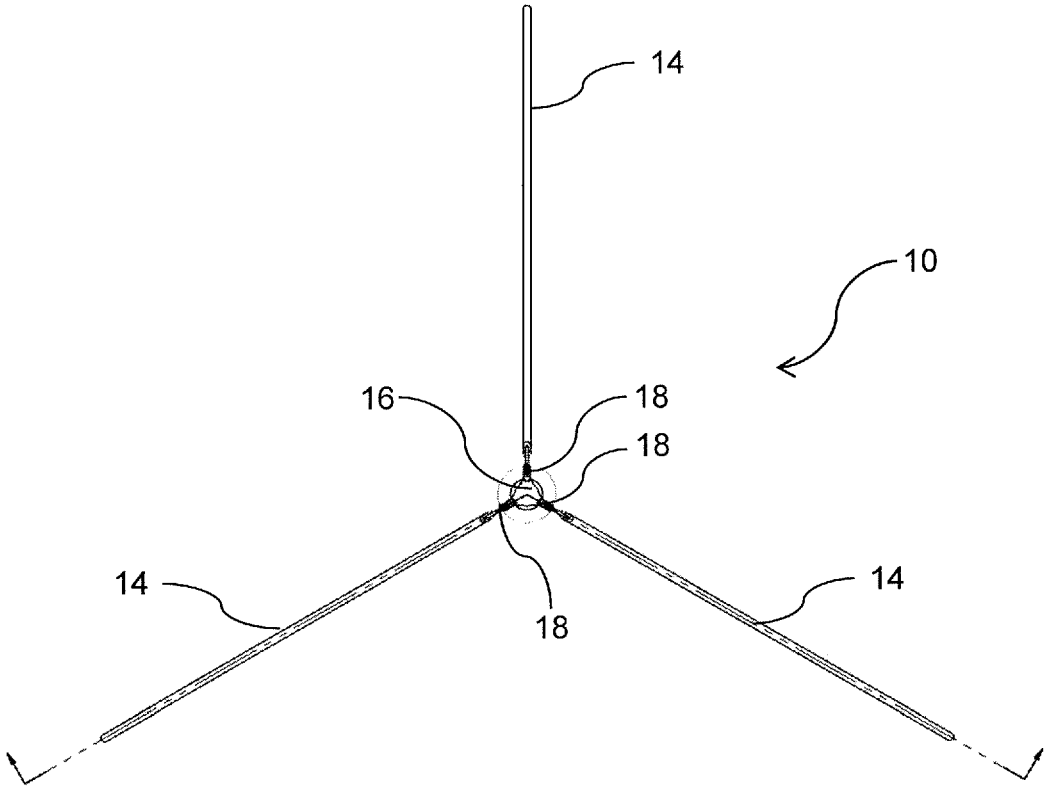
FIG. 1 is a top view of the foundation in accordance with an illustrative embodiment of the present disclosure.
Figure 2:
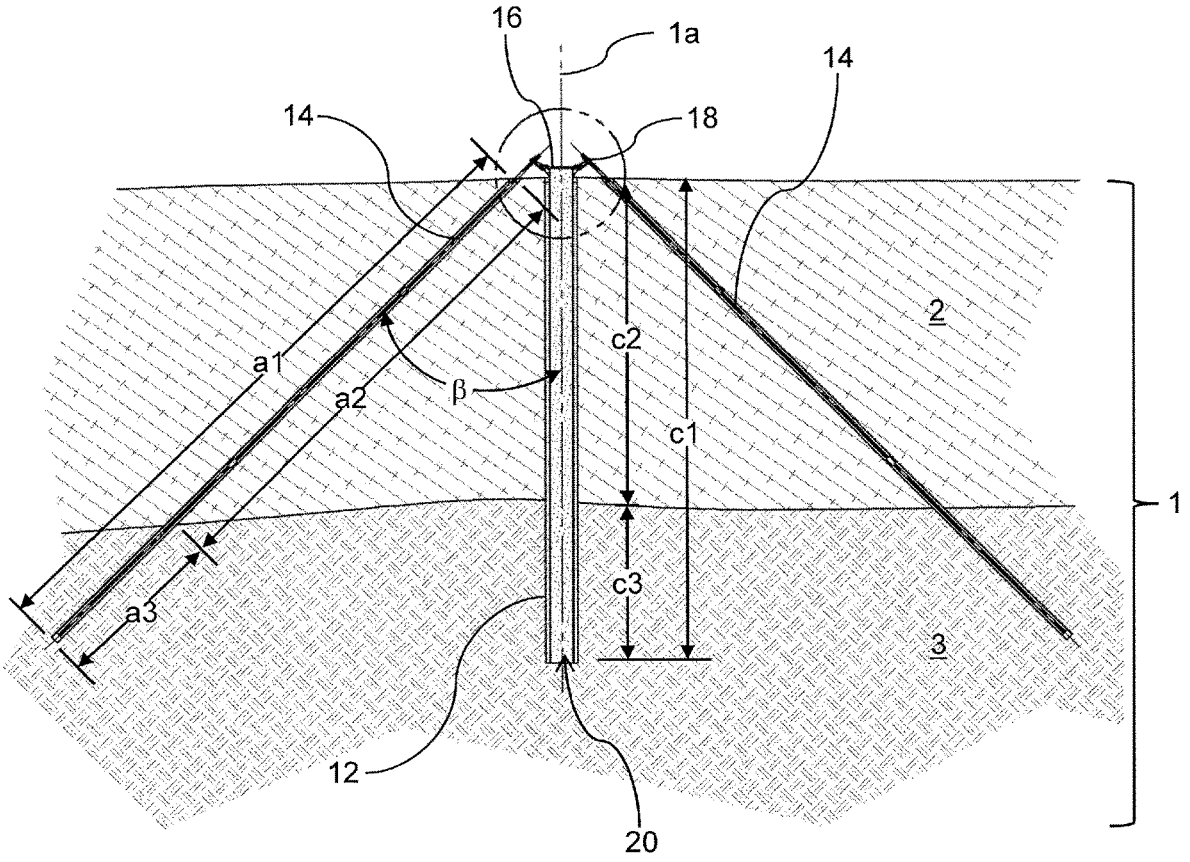
FIG. 2 is a cutaway side elevation of the foundation of FIG. 1 positioned in the soil.
Figure 3:
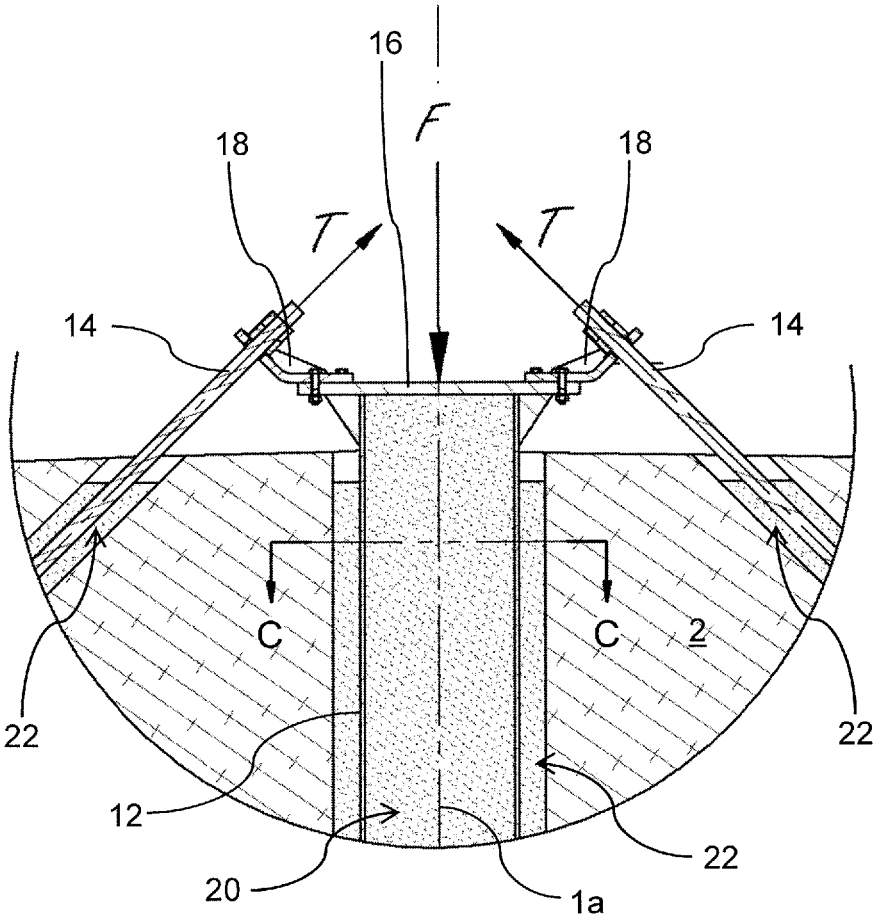
FIG. 3 is a close-up detail of FIG. 2.

Referring to FIGS. 1 to 3, the foundation 10 in accordance with an illustrative embodiment of the present disclosure is composed of a main column 12 (for example a hollow tube, solid cylinder, H-beam, etc.) for supporting a load F, generally three or more anchors 14 and a base 16 securing the anchors 14 to the main column 12. Referring more specifically to FIG. 3, the anchors 14 are removably secured to the base 16 using respective securing elements 18, which are configured to secure the anchors 14 at an angle β, measured between the axis 1*a* of the main column 12 and the axis 2*a* of the anchor 14, and an angle α between each adjacent anchor 14.

Figure 4:
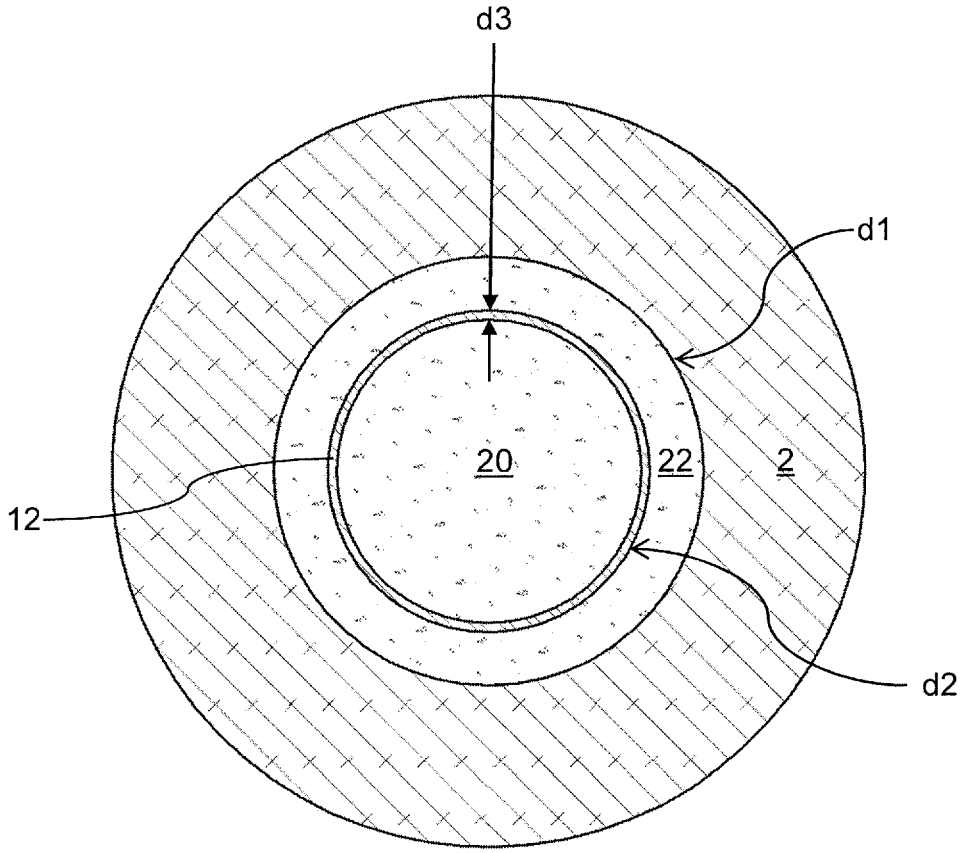
FIG. 4 is a cutaway top view of the main column along axis C-C of FIG. 3.
Figure 5:
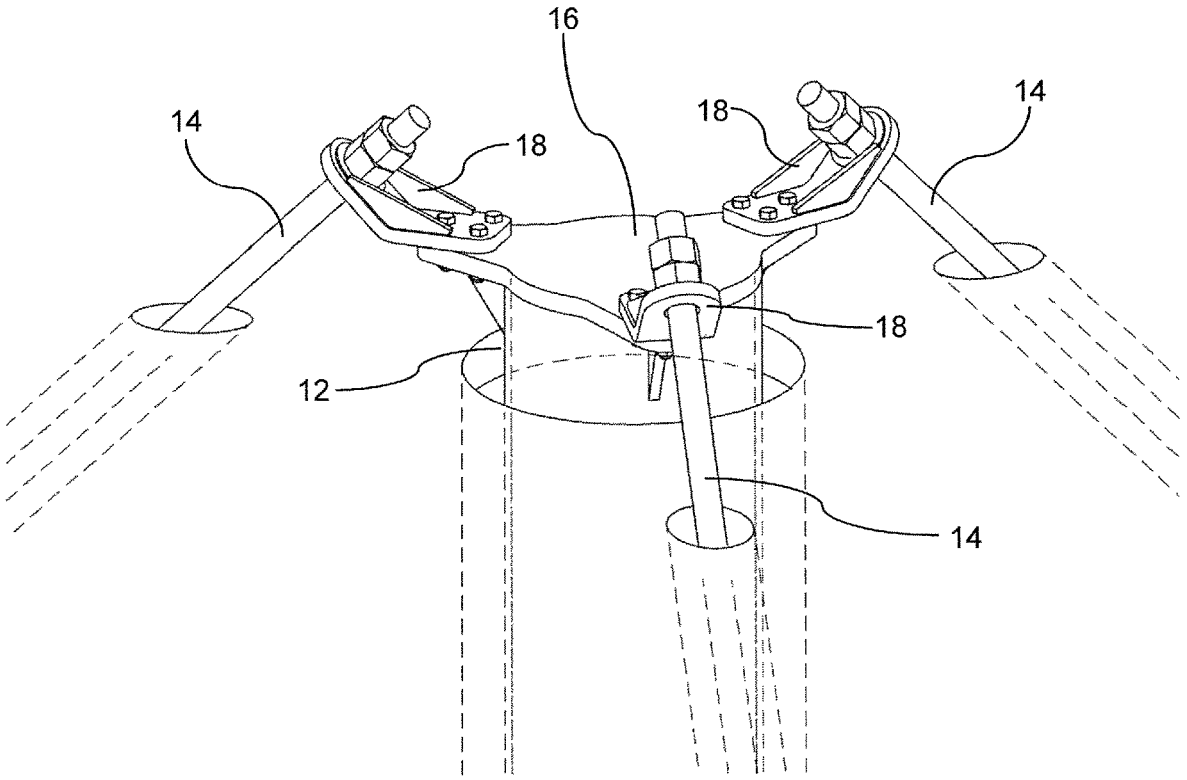
FIG. 5 is an isometric view of the base and the anchors.

Referring to FIG. 4, the dimensions of the main column 12, for example diameter d2 and thickness d3 in the case of a hollow tube, are determined by the load F to be supported and the length of the main column 12. Drilling a borehole for the insertion of the main column 12 is performed in the ground 1 along an axis parallel to the axis of the force exerted by the load F (i.e. the main column 12 does not need to be vertical) to a depth c1 determined by the depth c2 of the bedrock 3 and the drilling depth c3 into the bedrock 3 or, alternatively, until the soil 1 is sufficiently dense, so as to support the load F. The borehole diameter d1 should be large enough to allow insertion of the main column 12.

Referring back to FIG. 3, in the case where the main column 12 is hollow, its center is filled with a dense and virtually incompressible material 20, such as a slurry of 30 MPA concrete with expander (for example Intraplast®-N), to increase the compressive strength of the main column 12. Optionally, the clearance between the main column 12 and the wall of the borehole can also be filled with a sealant 22 such as a slurry of 30 MPA concrete with expander.

Then, with reference to FIG. 1, the anchors 14 are positioned so as to define an angle α between each adjacent anchor 14. In the illustrative embodiment there three anchors 14 are used, which means that angle α is 120°. It is to be understood that in an alternative embodiment more than three anchors 14 may be used, in which case angle α will be set so that adjacent anchors 14 are all equidistant. In a further alternative embodiment, the angle between adjacent anchors 14 may vary such that anchors 14 are not all equidistant in order to accommodate specific radial forces and/or terrain configurations. Referring to FIG. 2, drilling of a borehole for the insertion of each anchor 14 is performed at angle β that is determined by the radial forces induced by the structure to be supported by the base 16. In the illustrative embodiment angle β is between 15° and 60°. It is to be understood that in alternative embodiments this angle may vary depending on conditions of the soil, specific type of structure to be supported, etc. Furthermore, in the illustrative embodiment angle β is identical for each anchor 14, however, in alternative embodiments angle β may vary for one or more anchor 14 in order to provide proper tensioning (i.e. stripping force) T of the main column 12. In a further alternative embodiment, for example when the foundation 10 is used to support an electrical transmission tower, the radial forces may be only generally perpendicular to the electrical lines, the lines themselves acting as anchors. In this case, only two (and exceptionally only one) anchors 14 may be used, each on opposite sides and generally perpendicular to the transmission lines. It is to be understood that the angle between each anchor 14 and the transmission line may vary depending on radial forces and other considerations such as common wind conditions.

With reference to FIG. 2, the drilling depth a1 for the anchors 14, composed of the depth a2 to the bedrock 3 and the drilling depth a3 into the bedrock 3, is determined by the depth c2 of the bedrock 3, angle β and the drilling depth into the bedrock a2 necessary in relation to the tension T required for counteracting the radial forces exerted by the structure. Alternatively, the drilling depth a1 for the anchors 14 may be determined by the depth for which the soil 1 is sufficiently dense so as to support the required tension T. Referring to FIG. 3, once the anchors 14 have been inserted into their respective borehole, a sealant 22 is injected, for example as a slurry of 30 MPA concrete with expander.

Once the sealant 20 is dry, the base 16 is secured at the top of the main column 12. The design of the base 16 varies according to the structure to be supported, the type of main column 12 used and the number of anchors 14. After securing the base 16 at the top of the main column 12 (for example by soldering or bolting), each of the anchors 14 is secured using a respective securing element 18 and placed under tension T using a tension application mechanism that allows for power to be simultaneously applied on each anchor 14 along axis 2*a*. The tension T to be applied depends on the radial forces to the axis 1*a* (i.e. longitudinal axis) of the main column 12 to be counteracted according to the structure installed to ensure the stability of the main column 12.

Figure 6:
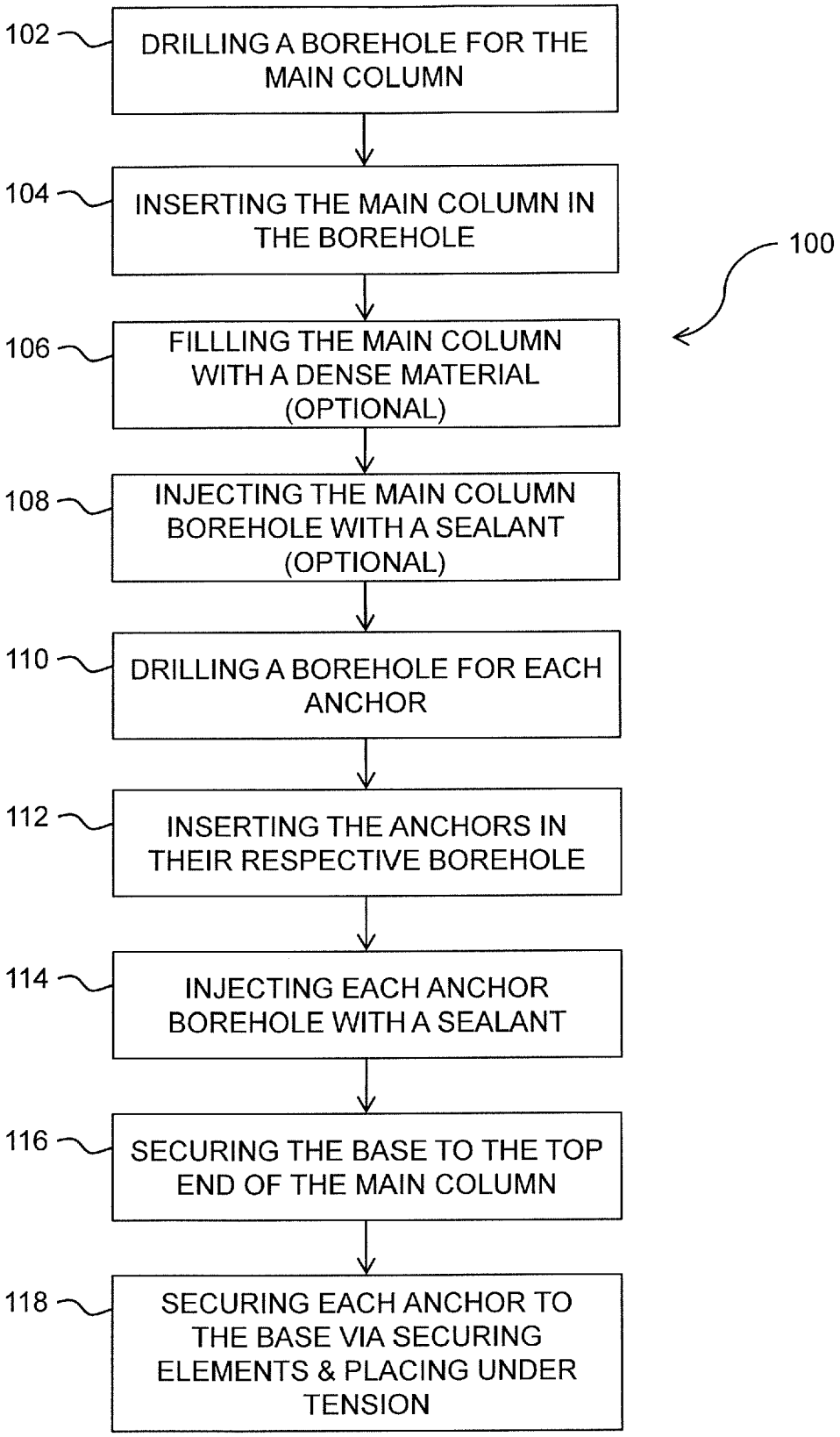
FIG. 6 is a flow diagram of the foundation for the support of a structure installation procedure in accordance with the illustrative embodiment of the present disclosure.

Referring now to FIG. 6, there is shown a flow diagram of the foundation for the support of a structure installation procedure 100 in accordance with the illustrative embodiment of the present disclosure. Steps of the procedure 100 are indicated by blocks 102 to 118.

The procedure 100 starts at block 102 with the drilling of a borehole in the ground 1 along an axis parallel to the axis of the force exerted by the load F for the insertion of the main column 12. The borehole is drilled to a depth c1 determined by the depth c2 of the bedrock 3 and the drilling depth c3 into the bedrock 3 or, alternatively, until the soil 1 is sufficiently dense, so as to support the load F. The diameter of the borehole is such as to be large enough to allow insertion of the main column 12.

At block 104, the main column 12 is inserted into the borehole and, optionally at block 106 in the case where the main column 12 is hollow, its center is filled with a dense and virtually incompressible material 20, such as a slurry of 30 MPA concrete, to increase the compressive strength of the main column 12.

Optionally still, at block 108, the clearance between the main column 12 and the wall of the borehole is filled with a sealant 22 such as a slurry of 30 MPA concrete with expander.

Then, at block 110, boreholes are drilled, at an angle β and spaced apart at an angle α, for the insertion of each anchor 14. The drilling depth a1 for the anchors 14, composed of the depth a2 to the bedrock 3 and the drilling depth a3 into the bedrock 3, is determined by the depth c2 of the bedrock 3, angle β and the drilling depth into the bedrock a2 necessary in relation to the tension T required. Alternatively, the drilling depth a1 for the anchors 14 may be determined by the depth for which the soil 1 is sufficiently dense so as to support the required tension T.

The angle β is determined by the radial forces induced by the structure to be supported by the base 16. In the illustrative embodiment angle β is between 15° and 60°. It is to be understood that in alternative embodiments this angle may vary depending on conditions of the soil, specific type of structure to be supported, etc. In the illustrative embodiment, angle β is identical for each anchor 14, however, in alternative embodiments angle β may vary for one or more anchor 14 in order to provide proper tensioning T of the main column 12.

The angle α between each adjacent anchor 14 is generally set so that adjacent anchors 14 are all equidistant. However, in an alternative embodiment, the angle between adjacent anchors 14 may vary such that anchors 14 are not all equidistant in order to accommodate specific radial forces and/or terrain configurations.

At block 112, the anchors 14 are inserted into their respective borehole following which, at block 114, a sealant 22 is injected, for example as a slurry of 30 MPA concrete with expander.

Once the sealant 20 has dried, the base 16 is secured, at block 116, at the top of the main column 12. The design of the base 16 varies according to the structure to be supported, the type of main column 12 used and the number of anchors 14.

Finally, at block 118, after securing the base 16 at the head of the main column 12, each of the anchors 14 is secured using a respective securing element 18 and placed under tension T using a tension application mechanism that allows for power to be simultaneously applied on each anchor 14 along axis 2*a*. The tension T to be applied depends on the radial forces to the axis 1*a* of the main column 12 to be counteracted according to the structure installed to ensure the stability of the main column 12.

The present foundation for the support of a structure and method of installation is applicable when the overburden layer 2 is more than 10 feet before reaching the bedrock 3. If the bedrock 3 is reached before 10 feet, the same technique applies with a main column 12 but without the anchors 14 as described hereinabove.

Although the present disclosure has been described with a certain degree of particularity and by way of illustrative embodiments and examples thereof, it is to be understood that the present disclosure is not limited to the features of the embodiments described and illustrated herein, but includes all variations and modifications within the scope of the disclosure as hereinafter claimed.

The invention claimed is:

1. A method for installing a foundation in a ground for supporting a structure thereon, the method comprising:

a) drilling of a main column borehole in the ground to a depth greater than 10 feet along an axis parallel to an axis of a force exerted by a load of the structure wherein at least a first 10 feet of said main column borehole is in an overburden layer without reaching a bedrock;

b) inserting a main column into the main column borehole;

c) drilling at least one anchor borehole, each anchor borehole at an angle away from the main column;

d) providing at least three anchors and inserting one of said anchors into each of said at least one anchor borehole;

e) injecting a sealant into each one of said at least one anchor borehole;

f) letting the sealant dry;

g) securing a base to a top of the main column;

h) securing to the base and placing under tension each of said at least three anchors, the tension being such as to counteract radial forces to be induced by the structure to a longitudinal axis of the main column.

2. A method in accordance with claim 1, wherein the placing under tension of each anchor inserted into each of the at least three anchor boreholes is performed using a tension application mechanism that allows for power to be simultaneously applied on each anchor.

3. A method in accordance with claim 1, wherein the sealant is a slurry of 30 MPA concrete with expander.

4. A method in accordance with claim 1, wherein the main column borehole is drilled into a bedrock under the ground to a depth such as to support the load.

5. A method in accordance with claim 1, wherein the main column borehole is drilled to a depth such that a soil composing the ground is sufficiently dense so as to support the load.

6. A method in accordance with claim 1, wherein the main column is selected from a group consisting of a hollow tube, a solid cylinder and an H-beam.

7. A method in accordance with claim 1, wherein the main column is hollow and further comprising filling the main column with a dense and incompressible material, thereby increasing the compressive strength of the main column.

8. A method in accordance with claim 7, wherein the dense and incompressible material is a slurry of 30 MPA concrete with expander.

9. A method in accordance with claim 1, further comprising the step of filling a clearance between the main column and a wall of the main column borehole with a sealant.

10. A method in accordance with claim 9, wherein the sealant is a slurry of 30 MPA concrete with expander.

11. A method in accordance with claim 1, wherein each of the at least three anchor boreholes is drilled into a bedrock under the ground to a depth so as to support the tension for counteracting the radial forces induced by the structure.

12. A method in accordance with claim 1, wherein each of the at least three anchor boreholes is drilled to a depth such that a soil composing the ground is sufficiently dense so as to support the tension for counteracting the radial forces induced by the structure.

13. A method in accordance with claim 1, wherein each anchor borehole angle is between 15° and 60°.

14. A method in accordance with claim 1, wherein each anchor borehole angle is determined by radial forces induced by the structure to be supported by foundation.

15. A method in accordance with claim 1, wherein each of the at least three anchor boreholes is drilled at an angle away from an adjacent one of the at least three anchor boreholes.

16. A method in accordance with claim 15, wherein the angles between adjacent anchors of the at least three anchor boreholes are such that the anchors are equidistant.

17. A method in accordance with claim 15, wherein the angles between adjacent anchors are such as to accommodate the radial forces induced by the structure to be supported by foundation.

18. A method for installing a foundation in a ground for supporting a structure thereon, the method comprising:

a) drilling of a main column borehole in the ground through an overburden layer and into a bedrock along an axis parallel to an axis of a force exerted by a load of the structure;

b) inserting a main column into the main column borehole with a top end of the main column at ground level;

c) drilling at least one anchor borehole, each anchor borehole at an angle away from the main column;

d) providing at least three anchors and inserting one of said anchors into each of the at least one anchor borehole;

e) injecting a sealant into each of the at least one anchor borehole;

f) letting the sealant dry;

g) securing a base to the top end of the main column;

h) securing to the base and placing under tension each of said at least three anchors, the tension being such as to counteract radial forces to be induced by the structure to a longitudinal axis of the main column.

19. A method for installing a foundation in a ground for supporting a structure thereon, the method comprising:

a) drilling of a main column borehole in the ground along an axis parallel to an axis of a force exerted by a load of the structure;

b) inserting a main column into the main column borehole;

c) drilling at least one anchor borehole, each one of said at least one anchor borehole at an angle away from the main column;

d) providing at least three anchors and inserting one of said anchors into each of the at least one anchor borehole;

e) injecting a sealant into each of the at least one anchor borehole;

f) letting the sealant dry;

g) securing a base to a top end of the main column, said base covering the top end of the main column and comprising at least three securing elements for connecting to respective ones of said at least three anchors;

h) placing under tension each one of said at least three anchors connected to a corresponding one of said three securing elements, the tension being such as to counteract radial forces to be induced by the structure to a longitudinal axis of the main column.

* * * * *